US007789387B2

(12) United States Patent
Trudeau et al.

(10) Patent No.: US 7,789,387 B2
(45) Date of Patent: Sep. 7, 2010

(54) ROLLER ASSEMBLY FOR FEEDING STACKED SHEET MATERIAL

(75) Inventors: Joseph A. Trudeau, Watertown, CT (US); Robert F. Marcinik, Wallkill, NY (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 12/341,485

(22) Filed: Dec. 22, 2008

(65) Prior Publication Data

US 2010/0156032 A1 Jun. 24, 2010

(51) Int. Cl.
*B65H 5/02* (2006.01)

(52) U.S. Cl. ..... 271/273; 271/274

(58) Field of Classification Search ..... 271/272, 271/273, 274, 275; 198/624, 836.2, 620
See application file for complete search history.

(56) References Cited

U.S. PATENT DOCUMENTS 3,246,822 A * 4/1966 Skeen ..... 226/155
4,346,883 A * 8/1982 Speraggi ..... 271/274
4,605,218 A * 8/1986 Knepper et al. ..... 271/238
5,011,129 A * 4/1991 Holbrook ..... 271/274
5,062,600 A * 11/1991 Holbrook et al. ..... 271/35
5,236,542 A * 8/1993 Bailey et al. ..... 156/583.1
5,333,848 A * 8/1994 Rubscha ..... 271/3.14
5,350,170 A * 9/1994 Emigh et al. ..... 271/273
6,308,820 B1 * 10/2001 Munneke ..... 198/626.2
7,506,870 B2 * 3/2009 Park ..... 271/274
2008/0042340 A1 * 2/2008 Linder et al. ..... 271/274

* cited by examiner

*Primary Examiner*—Kaitlin S Joerger
(74) *Attorney, Agent, or Firm*—Brian A. Collins; Angelo N. Chaclas

(57) ABSTRACT

A roller assembly for conveying stacked sheet material along a feed path. The roller assembly includes a first roller adapted for rotation within a housing, a second roller pivotally mounting about an axis to the housing and opposing the first roller to define a roller nip, a spring biasing mechanism operative to bias the second roller about the pivot axis toward the first roller to effect optimum frictional engagement of the roller nip with the face surfaces of the stacked sheet material and a transmission assembly operative to (i) transfer rotational motion of the first roller to the second roller, (ii) drive the first and second rollers in opposing directions to convey the stacked sheet material along the feed path, and (iii) facilitate pivot motion of the second roller about the pivot axis to vary the spacing of the roller nip and accommodate stacks of sheet material which vary in thickness.

11 Claims, 7 Drawing Sheets

ROLLER ASSEMBLY FOR FEEDING STACKED SHEET MATERIAL

TECHNICAL FIELD

The present invention relates to apparatus for conveying sheet material, and more particularly, to a new and useful roller assembly for feeding stacked sheets of material, e.g., sheet material collations in a mailpiece creation system.

BACKGROUND OF THE INVENTION

Mailpiece creation systems such as mailpiece inserters are typically used by organizations such as banks, insurance companies, and utility companies to periodically produce a large volume of mailpieces, e.g., monthly billing or shareholders income/dividend statements. In many respects, mailpiece inserters are analogous to automated assembly equipment inasmuch as sheets, inserts and envelopes are conveyed along a feed path and assembled in or at various modules of the mailpiece inserter. That is, the various modules work cooperatively to process the sheets until a finished mailpiece is produced.

A mailpiece inserter includes a variety of apparatus for conveying sheet material along the feed path. Commonly, a roller assembly, comprising opposed driven and idler rollers, is employed to perform this principal function. The opposed rollers form a conveyance nip to capture the face surfaces of the sheet, or stack of sheets, and drive the material along the feed path.

While roller assemblies of the prior art have proven successful and reliable for conveying a single sheet of material or a small stack of sheet material, e.g., less than five (5) stacked sheets, difficulties are encountered when conveying a large stack of sheets, e.g., a stacked collation of sheet material consisting of ten (10) or more sheets. That is, when transporting a large stack of sheet material, the roller assembly shingles the stacked sheet material, i.e., a condition wherein the edges of the stacked sheets become misaligned. Inasmuch as the stacked sheet material is no longer in register, an additional processing step may be required to align the edges before subsequent operations. For example, a stacked sheet material collation should be registered before stitching or stapling operations. Similarly, it may be necessary to align the edges to insert the stacked sheet material into a mailing envelope.

A need, therefore, exists for a roller assembly which accurately and reliably conveys stacked sheet material while maintaining edge registration thereof.

SUMMARY OF THE INVENTION

A roller assembly is provided for conveying stacked sheet material along a feed path. The roller assembly includes a first roller adapted for rotation within a housing, a second roller pivotally mounting about an axis to the housing and opposing the first roller to define a roller nip, and a transmission assembly operative to (i) transfer rotational motion of the first roller to the second roller, (ii) drive the first and second rollers in opposing directions to convey the stacked sheet material along the feed path, and (iii) facilitate pivot motion of the second roller about the pivot axis to vary the spacing of the roller nip and accommodate stacks of sheet material which vary in thickness. Spring biasing mechanisms are also employed to bias the second roller about the pivot axis toward the first roller to effect optimum frictional engagement of the roller nip with the face surfaces of the stacked sheet material.

DETAILED DESCRIPTION OF THE INVENTION

The present invention will be described in the context of a Feed Input Module (FIM) for a mail creation system. In one embodiment of the invention, input and output roller assemblies are disposed at each end of the FIM and are each adapted to convey multi-sheet collations while maintaining edge registration of the stacked sheet material. While each of the roller assemblies is employed in a FIM, the inventive roller assembly may be employed in combination with any module/assembly which handles, processes, and/or conveys multi-sheet collations. The FIM is merely used to illustrate the teachings of the present invention and is not intended to limit the meaning or scope of the appended claims.

Figure 1:
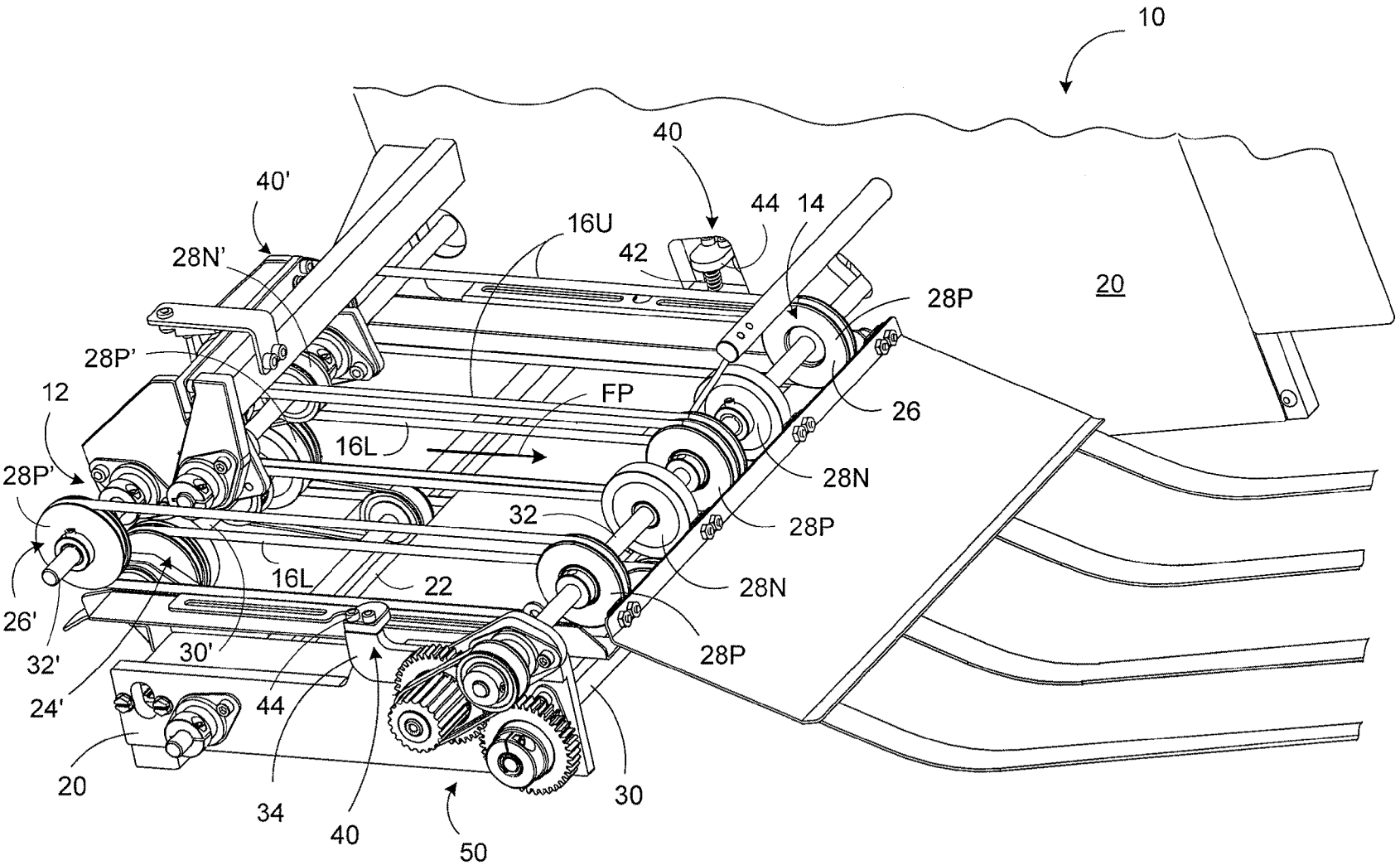
FIG. 1 is a perspective view of a Feed Input Module (FIM) according to the present invention depicted from an output side thereof and includes input and output roller assemblies adapted to convey stacked, multi-sheet collations.
Figure 2:
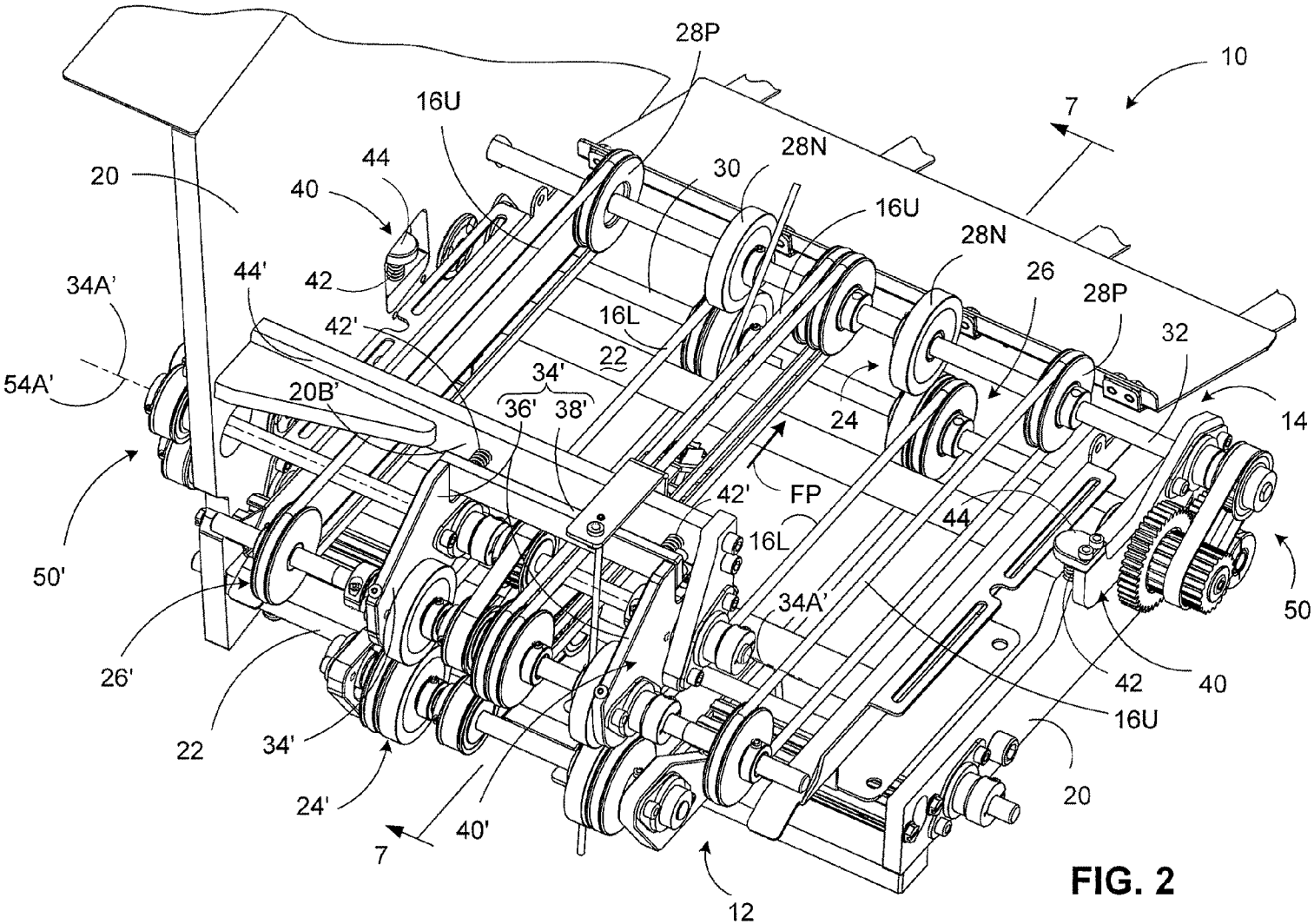
FIG. 2 is a perspective view of the FIM depicted from an input side thereof.
Figure 3:
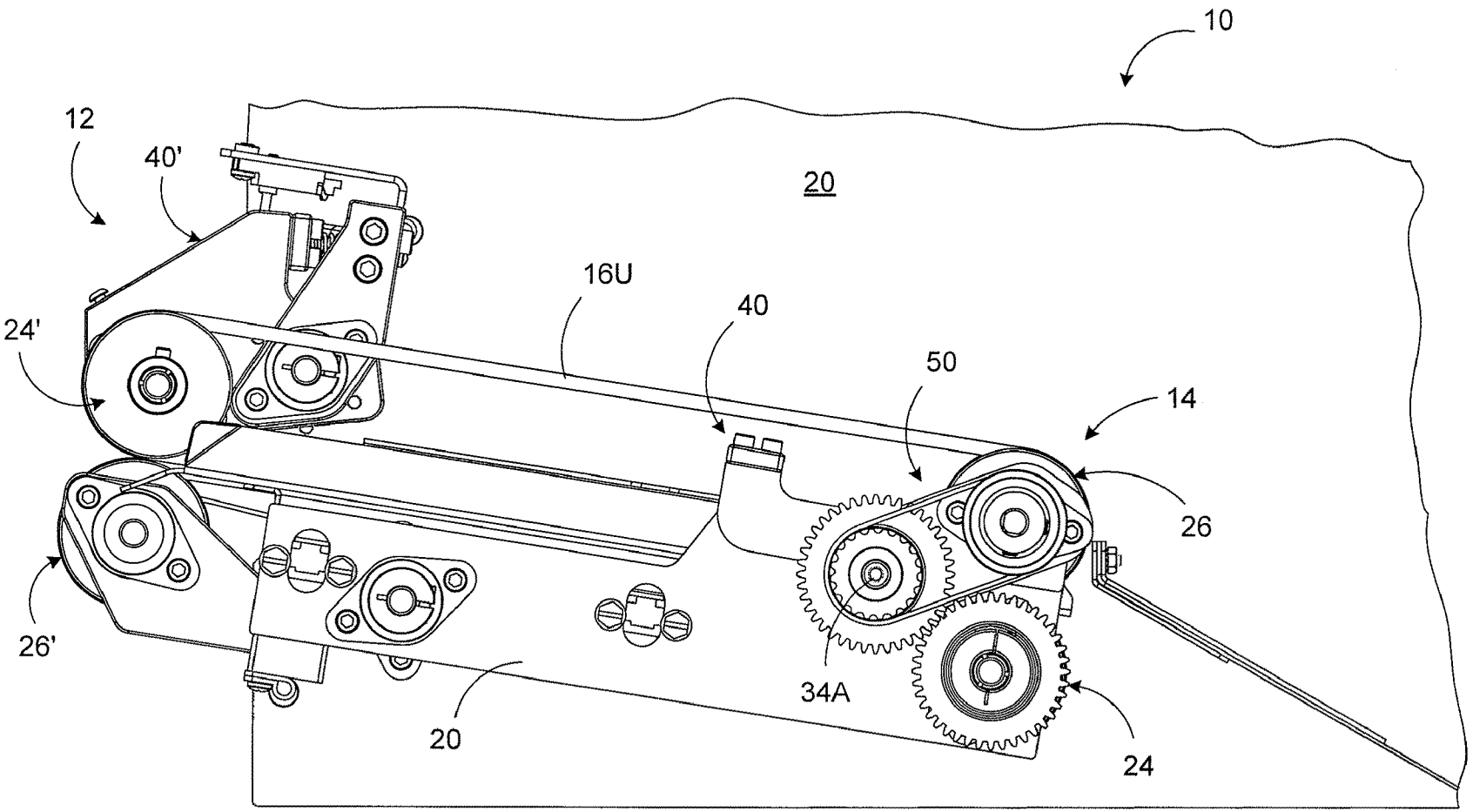
FIG. 3 is a front profile view of the FIM illustrating the components for driving the input and output roller assemblies.

In FIGS. 1, 2 and 3, a FIM 10 is depicted including input and output roller assemblies 12 and 14, respectively, disposed at input and output ends of the FIM 10. The roller assemblies 12, 14 are adapted to drive a plurality of compliant rings/belts 16U, 16L which are arranged to define planar drive surfaces for conveying a stacked collation of sheet material (not shown in FIGS. 1-3). More specifically, the roller assemblies 12, 14 drive a first or lower series of conveyance rings/belts 16L and a second or upper series of conveyance rings/belts 16U. The rings/belts 16L, 16U are disposed over and driven by rollers 24, 26 24', 26' associated with each of the roller assemblies 12, 14 and are arranged to define upper and lower planar drive surfaces. The planar drive surfaces frictionally engage the face surfaces of the stacked collation to convey the stacked collation along a feed path FP. That is, the stacked collation enters the FIM 10 at the input end, is captured or sandwiched between the rings/belts 16L, 16U, and is driven to the output end by the motion of the rings/belts 16L, 16U. In the described embodiment, the roller assemblies 12, 14 drive a series of two (2) lower rings/belts 16L and four (4) upper rings/belts 16U. The two lower rings/belts 16L are disposed between first and second pairs of the upper rings/belts 16U, hence, the upper and lower rings/belts 16L, 16U are not aligned, but staggered laterally across the width of the FIM 10.

To facilitate the description, the output roller assembly 14 will be described in detail with the understanding that the input roller assembly 12 includes many of the same structural and functional components. While the roller assemblies 12, 14 include the same combination of components, one difference relates to the location of a spring biasing mechanism for optimizing the nip spacing of each of the roller assemblies 12, 14 i.e., for optimum frictional engagement with the face surfaces of the stacked sheet material. With respect to the output roller assembly 14, the spring biasing mechanism 40 is located at an outboard location, i.e., outboard of the outermost rings/belts 16L, 16U. With respect to the input roller assembly 12, the biasing mechanism 40' is located at an inboard location, i.e., inboard of the outermost rings/belts 16L, 16U.

The output roller assembly 14 is mounted between and supported by the FIM housing which includes stationary sidewalls 20 structurally interconnected by a plurality of crossbeam members 22. The sidewalls 20 and crossbeam members 22 provide a structural base for supporting the various components/assemblies of the FIM 10. The output roller assembly 14 comprises first and second rollers 24, 26, which are adapted for rotation about first and second rotational axes 24A, 26A, respectively, i.e., parallel axes. The first and second rollers 24, 26 are disposed in opposed relation and each comprise a plurality of spaced-apart rolling elements 28P, 28N. In the described embodiment, a first set of rolling elements 28P accept and drive the rings/belts 16L, 16U while a second set of rolling elements 28N engage and drive the multi-sheet collation. Hence, each roller 24, 26 comprises rolling elements 28P, 28N which perform slightly different functions, i.e., the first set of rolling elements 28P conveys the stacked sheets material by driving the rings/belts 16L, 16U while and the second set of rolling elements 28N moves the stacked sheet material through the roller nip defined by and between the rolling elements 28N. While the described embodiment employs a plurality of rolling elements 28P, 28N, it should be appreciated that any rolling element capable of accepting and driving the rings/belts 16U, 16L and/or defining a roller nip to convey sheet material may be employed. For example, a continuous roller (i.e., also referred to as a "log roller") having a cylindrical drive surface and/or a plurality of pulley grooves formed therein may be employed. Consequently, in the context used herein, the term "roller" means at least one rolling element adapted for rotation about an axis.

Figure 4:
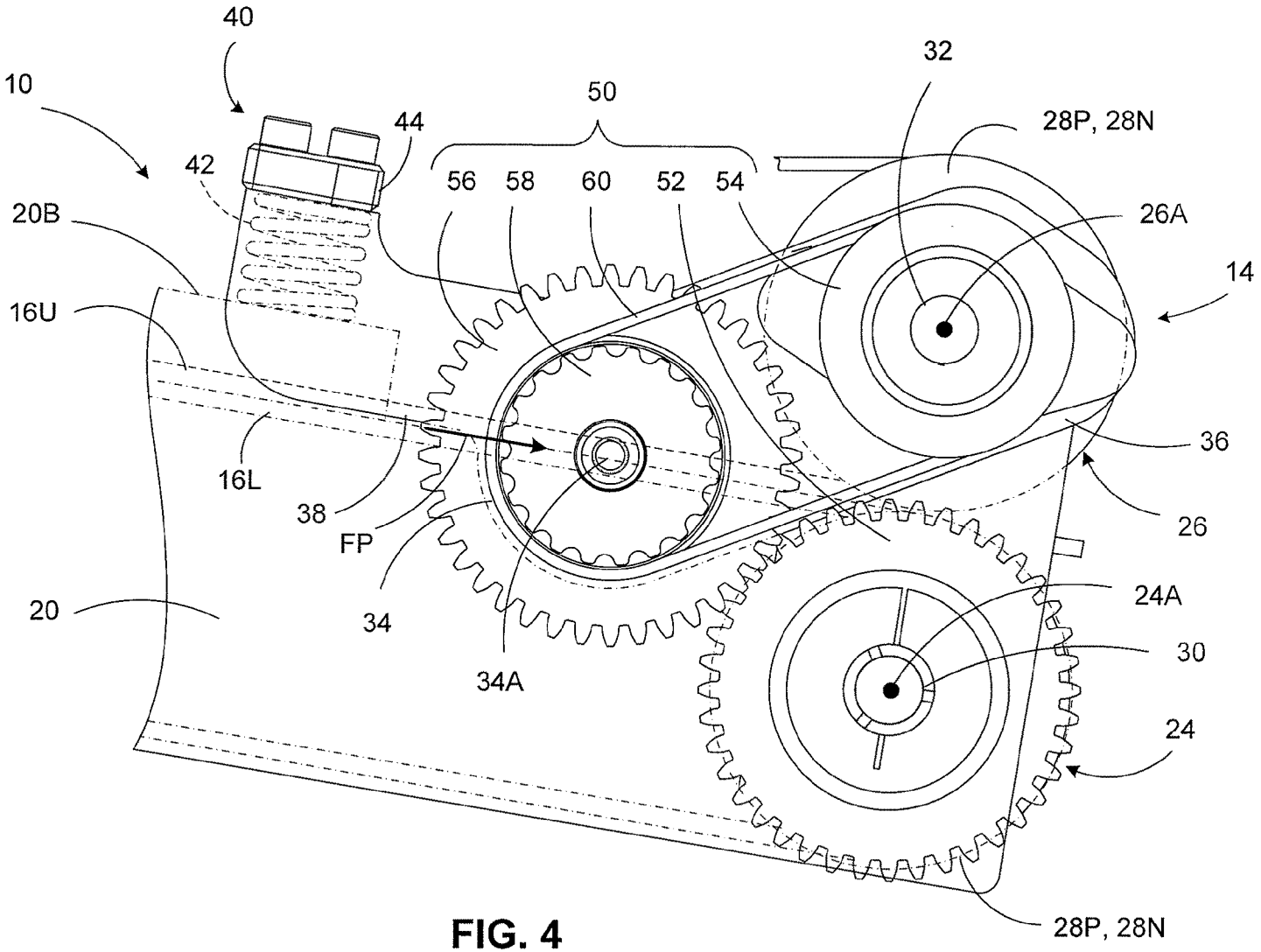
FIG. 4 is an enlarged side view of the output roller assembly including first and second rollers, a transmission assembly for driving the first and second rollers and a mount accommodating pivot motion of one of the first and second rollers to enable separation when conveying multi-sheet collations.

In FIGS. 2, 3 and 4, the rolling elements 28P, 28N associated with the first roller 24 are mounted for rotation about a shaft 30 (see FIG. 2) while the rolling elements 28P, 28N associated with the second roller 26 are mounted for rotation about a shaft 32 (FIG. 2). The shafts 30, 32 associated with the rollers 24, 26 are mounted to the side walls 20 of the FIM 10 such that multi-sheet collations of variable thickness may pass therebetween. In the described embodiment, the spacing between the rollers 24, 26, i.e., the nip spacing, may vary by pivotally mounting one of the shafts to the side walls 20 of the FIM 10. In the described embodiment, the upper or second roller 26 is pivotally mounted about an axis 34A by a first lever 34 disposed at the each end of the roller shaft 30. More specifically, each of the levers 34 includes a lever arm 36 which rotationally mounts each end of the roller shaft 32.

The spring biasing mechanism 40 is located at the ends the of second roller 26 and biases the second roller 26 toward the first roller 24 to effect optimum frictional engagement with the face surfaces of the stacked sheet material. More specifically, the spring biasing mechanism 40 includes a pair of radial arm segments 38 and a coil spring 42 interposing a flanged end 44 of each of the radial arm segments 38 and a bearing surface 20B formed in combination with each side wall 20 of the FIM housing. Each of the radial arm segments 38 extends outwardly from the pivot axis 34A of a respective lever 34 and forms a second arm of each of the levers 34. In the described embodiment the radial arm segments 38 are integrated with the lever arms 36 to form a unitary L-shaped structure, however, the radial arm segments 38 may be affixed to any portion of the lever arms 36 or any portion of the second roller 26, provided that the radial arm segments 38 permit pivoting motion of the second roller 26 about the pivot axis 34A.

In addition to the rollers 24, 26 and the spring biasing mechanism 40, the output roller assembly 14 includes a transmission assembly 50. The transmission assembly 50 is supported within the FIM housing structure and is operative to: (i) transfer rotational motion of the first roller 24 to the second roller 26, (ii) drive the first and second rollers 24, 26 in opposing directions to convey the stacked sheet material along the feed path FP, and (iii) facilitate pivot motion of the second roller 26 about the pivot axis 34A to vary the spacing of the roller nip. With respect to the latter, the variable nip spacing accommodates stacked sheet material of variable thickness. More specifically, the transmission assembly 50 includes (i) a first input gear 52 mounting to and rotating with the shaft 30 of the first roller 24, i.e., about its rotational axis 24A, (ii) a second input gear 54 mounting to and rotating with the shaft 32 of the second roller 26, i.e., about its rotational axis 26A, (iii) a torque transmitting gear 56, mounted for rotation to the sidewall 20 about an axis of rotation 56A coincident with the pivot axis 34A of the second roller 26, and (iv) a belt drive assembly 58, 60 operative to transfer rotational input from the torque transmitting gear 56 to the second input gear 54 thereby facilitating pivot motion of the second roller 26 about the pivot axis 34A.

The belt drive assembly includes a pinion gear 58 mounting to and rotating with the torque transmitting gear 56, i.e., about the same rotational axis 56A, and a cogged belt 60 rotationally coupling the torque transmitting gear 56 to the second input gear 54. Consequently, rotation of the torque transmitting gear 56 effects rotation of the second roller 26 through the belt drive assembly 58. 60, i.e., the cogged belt 60 which rotationally couples the pinion gear 58 to the second input gear 54. In the described embodiment, the pinion gear 58 mounts directly to the face of the torque transmitting gear 56 and the second input gear 54 mounts to an end of the roller shaft 32. While this arrangement effects transmission of torque at a location outboard of the belts 16U, 16L, the second input gear 54 may be mounted to a shaft to change the location of the torque input 26, e.g., driving toque to the second roller 26 to a central location. Such an arrangement will be described in connection with the input roller assembly 12.

Figure 5:
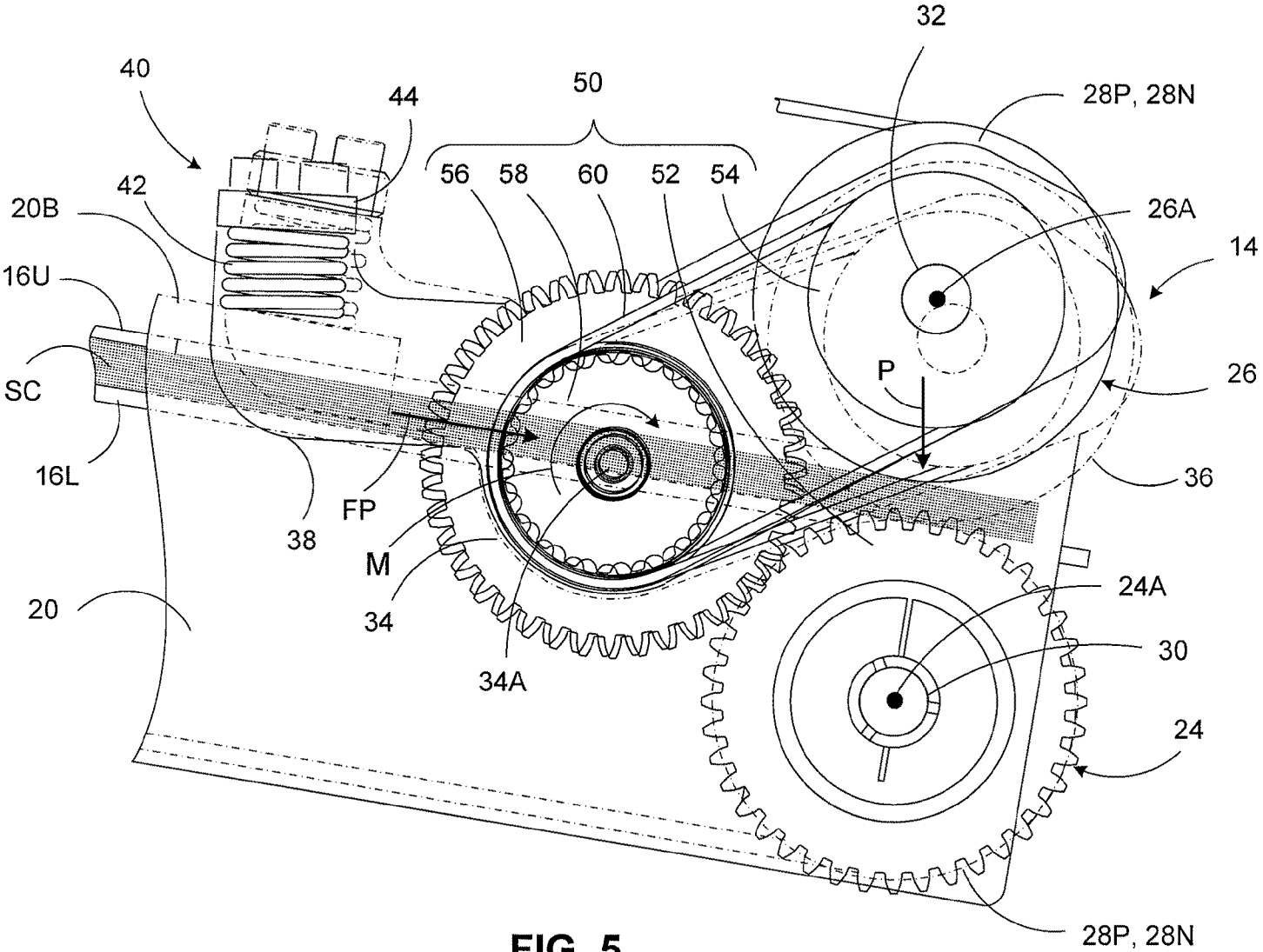
FIG. 5 shows the output roller assembly of FIG. 4 and the pivot motion of one of the driven rollers as a multi-sheet collation passes between the first and second rollers.
Figure 6:
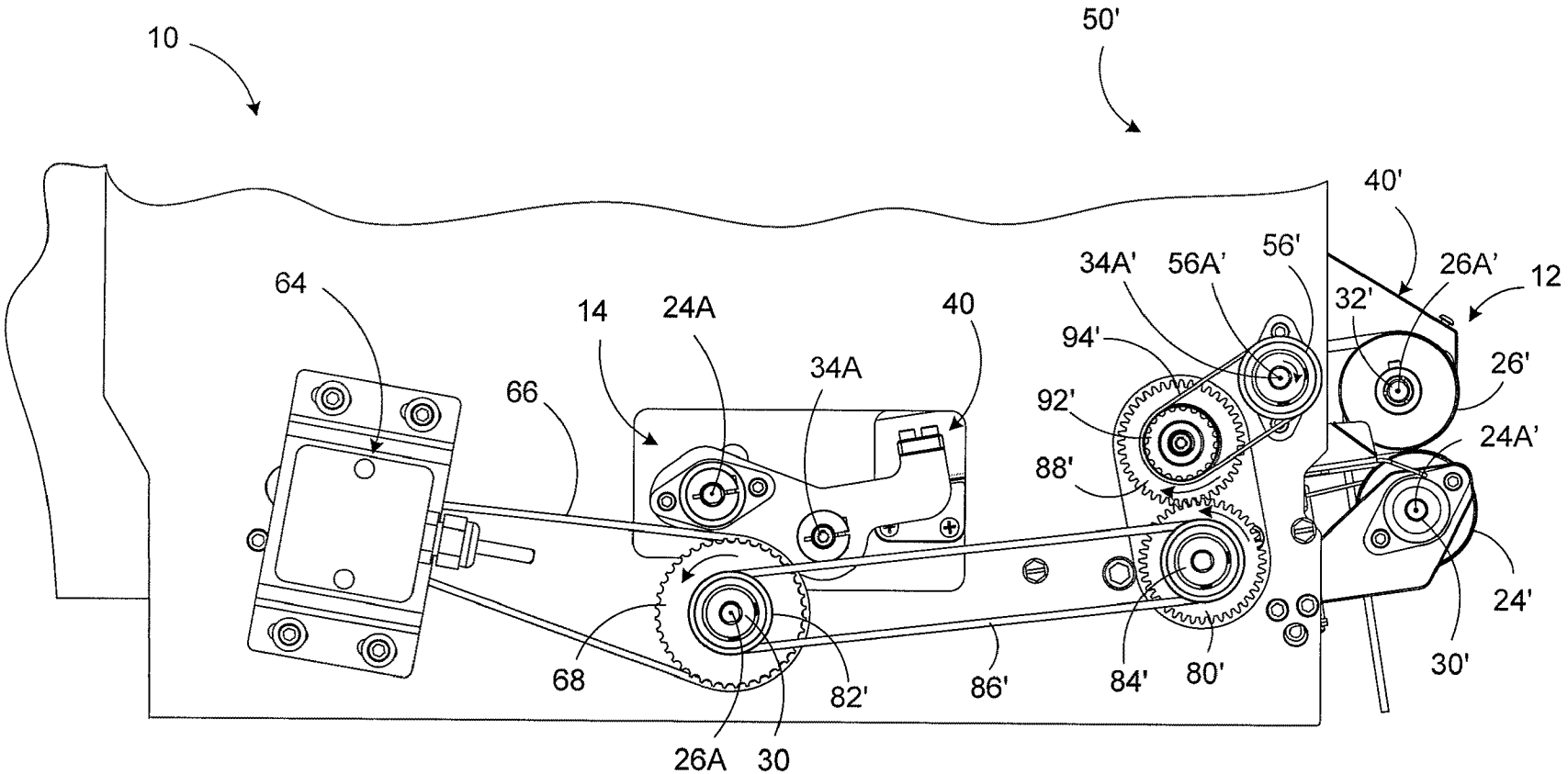
FIG. 6 is a rear profile view of the FIM illustrating a single motor adapted to drive both input and output roller assemblies.

In operation and referring to FIGS. 5 and 6, a motor 64 (see the backside profile view of FIG. 6) drives a cogged belt 66 which, in turn, drives a third input gear 68. The third input bear 68 is mounted to and drives the shaft 30 of the first roller 24, which in turn drives the first input gear 52. Therefore, the third input gear 68, in combination with the transmission assembly 50, drives the upper and lower rollers 24, 26 in opposite directions and at the same rotational velocity. Additionally, the rolling elements 28P of each of the rollers 24, 26 drives the upper and lower belts 16U, 16L in the direction of the feed path FP. That is, the upper and lower belts 16U, 16L capture a multi-sheet collation SC (see FIG. 5) therebetween and transport the collation SC to the rolling elements 28N. As the multi-sheet collation SC passes between the rolling elements 28N, the spring biasing mechanism 40 applies a biasing moment M about the pivot axis 34A, i.e., to urge the second roller 26 toward the first roller 24. Depending upon the thickness of the multi-sheet collation SC, the second roller 26 may pivot upward, i.e., in a counterclockwise direction, from a first position (shown in dashed lines) to second position (shown in solid lines in FIG. 5) about the axis 34A. Irrespective the magnitude of pivot displacement, the moment M produced by the spring biasing mechanism 40 produces a force P, normal to the face surfaces of the collation SC. As such, the normal force P induces friction forces, (i.e., between the rollers 24, 26 and the face surfaces of the collation SC and between the individual sheets of the collation SC) which prevent slippage and/or misalignment, e.g., shingling, of the sheet material collation SC.

Figure 7:
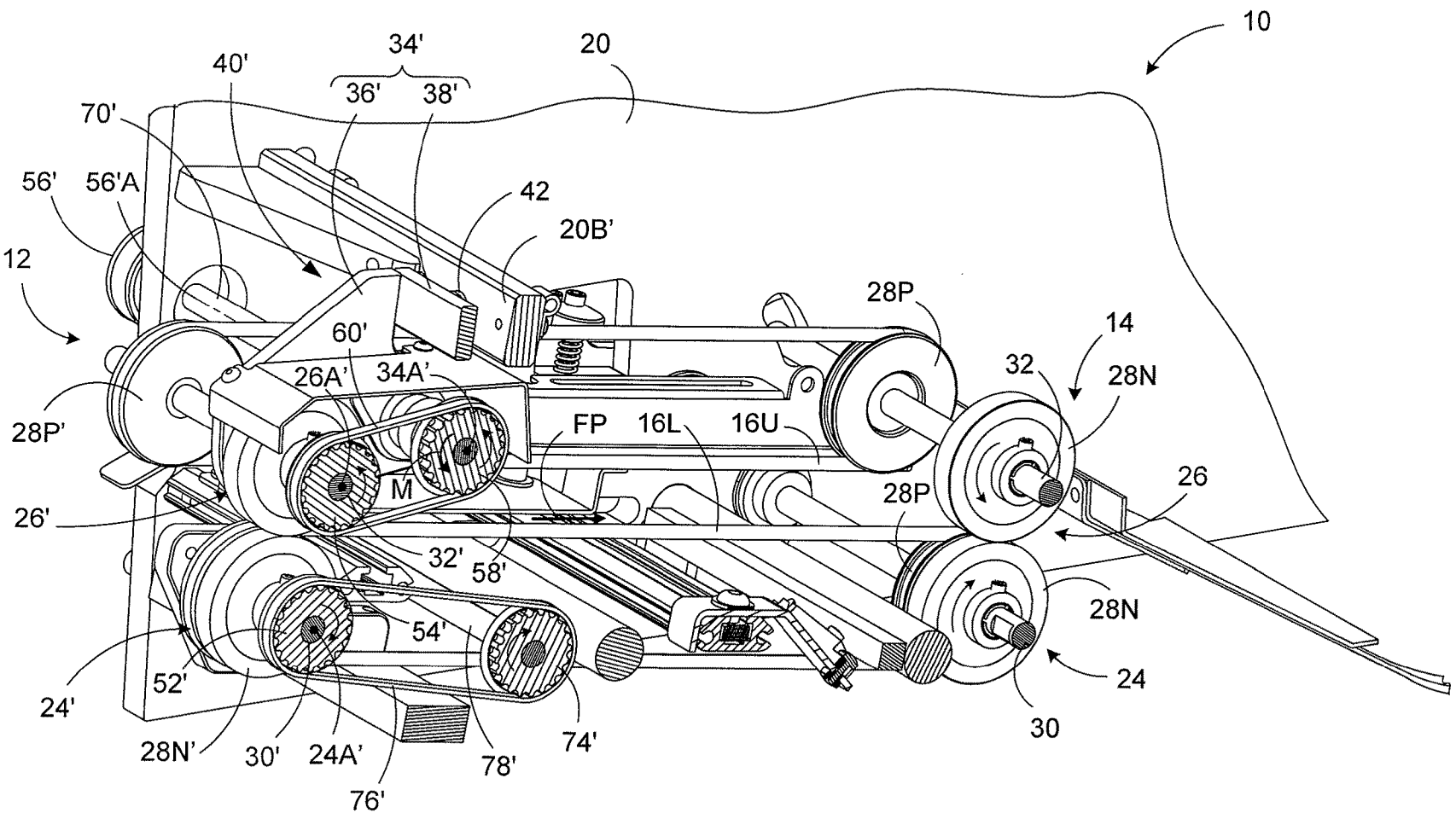
FIG. 7 depicts a cross-sectional view taken substantially along line 7-7 of FIG. 2 depicting the relevant details of a spring biasing mechanism in connection with the input roller assembly.

In FIGS. 6 and 7, the input roller assembly 12 includes essentially the same structural and functional elements as the output roller assembly 14, but for the location of the spring biasing mechanism 40' and inclusion of several intermediate gears for driving the roller assembly 12. Similar to the preceding description, the transmission assembly 50' of the input roller assembly 12 is supported within the FIM housing structure and is operative to: (i) transfer rotational motion of the first roller 24' to the second roller 26', (ii) drive the first and second rollers 24', 26' in opposing directions to convey the stacked sheet material along the feed path FP, and (iii) facilitate pivot motion of the second roller 26" about the pivot axis 34A" to vary the spacing of the roller nip. More specifically, the transmission assembly 50 includes (i) a first input gear 52' (see FIG. 7) mounting to and rotating with the shaft 30' of the first roller 24', i.e., about its rotational axis 24A', (ii) a second input gear 54' mounting to and rotating with the shaft 32' of the second roller 26', i.e., about its rotational axis 26A', (iii) a torque transmitting gear 56' (see FIG. 6), mounted for rotation to the sidewall 20 about an axis of rotation 56A' coincident with the pivot axis 34A' of the second roller 26', and (iv) a belt drive assembly 58', 60' operative to transfer rotational input from the torque transmitting gear 56' to the second input gear 54' thereby facilitating pivot motion of the second roller 26' about the pivot axis 34A'.

The torque transmitting gear 56' is a spur gear mounted for rotation to the sidewall 20 and drives a shaft 70' which extends through, and is supported by, the sidewall 20 of the FIM housing. The belt drive assembly includes a pinion gear 58' mounting to and rotating with the shaft 70' of the torque transmitting gear 56', and a cogged belt 60' rotationally coupling the shaft 70', and, consequently, the torque transmitting gear 56', to the second input gear 54'. Therefore, rotation of the torque transmitting gear 56' effects rotation of the second roller 26' through the belt drive assembly 58', 60'.

Torque drive to the first input gear 52' (see FIG. 7) is made through a first intermediate belt drive assembly which includes a pinion gear 74' and a cogged belt 76' for rotationally coupling the input gear 52' to the pinion gear 74'. The pinion gear 74' is driven by a shaft 78' which extends through, and is supported by, the sidewall 20 of the FIM housing. The shaft 78' is driven by a first intermediate spur gear 80' which is rotationally coupled to the shaft 30 associated with the first roller 24 of the output roller assembly 14. That is, a connecting belt drive assembly transfers torque to the input roller assembly 12 from the output roller assembly 14. The connecting belt drive assembly includes a first take-off pinion 82' mounting to and rotating with the third input gear 68 (a gear which drives first roller 24 of the output roller assembly 14), a first input pinion 84' mounting to and rotating with the first intermediate spur gear 80' (a gear which drives the first roller 24' of the input roller assembly 12'), and a cogged belt 86' rotationally coupling the take-off and input pinions 82', 84'.

The first intermediate spur gear 80' also drives a second input spur gear 88' which is rotationally coupled to the torque transmitting gear 56' via a second intermediate belt drive assembly. The second intermediate belt drive assembly includes a second take-off pinion 92' mounting to and rotating with the second intermediate spur gear 88', and a cogged belt 94' which rotationally couples the second take-off pinion 92' to the torque transmitting gear 56'. Consequently, the transmission assembly 50' for driving the first and second rollers 24' 26 of the input roller assembly 12 includes intermediate spur gears 80', 88', take-off and input pinions 58', 74', 82', 84', 92', and several cogged belts 60', 76', 86', 94'. While the transmission assembly 50' of the input roller assembly 12 includes various additional gears, pinions and belts, it should be appreciated that the previously described transmission assembly 50 associated with the output roller assembly 14 can be employed for driving the rollers 24', 26' of the input roller assembly 12.

The spring biasing mechanism 40' of the input roller assembly 12 is similar to the biasing mechanism 40 of the output roller assembly 14. Referring to FIGS. 2, and 7, the spring biasing mechanism 40' includes a yoke-shaped lever 34' having a pair of radial arm segments 36' connected by a crossbeam structure 38'. The radial arm segments 36' and crossbeam structure 38' pivot about the rotational axis 56A' of the torque transmitting gear 56' and the pivot axis 34A' of the second roller 26'. Furthermore, the spring biasing mechanism 40' includes a pair of coil springs 42' disposed between the crossbeam structure 38' and a cantilevered beam 44' projecting laterally from, and normal to, the sidewall 20 of the FIM housing.

The cantilevered beam 44' provides a rigid bearing surface 20B' for mounting the coil springs 42' and support for both the spring biasing mechanism 40" and the shaft of the second roller 26'. The support is provided at a central location along the second roller 26', i.e., inboard of the outermost conveyor belts 16U, 16L, such that the end portions of the shaft 32' remain unrestrained. As such, this mounting arrangement provides a simple structural support which facilitates access to, and between, the rollers 24', 26' such as may be required for jam clearance.

In operation, the spring biasing mechanism 40' urges the second roller 26' toward the first roller 24 to effect optimum frictional engagement with the face surfaces of the stacked sheet material. Specifically, the coil springs 42' act on the lever 34" to apply a biasing moment M (see FIG. 7) about the pivot axis 34A' thereby varying the nip spacing as a function of the thickness of the multi-sheet collation SC.

In summary, the roller assemblies 12, 14 of the FIM 10 convey multi-sheet collations SC while maintaining registration and alignment of the stacked collation SC. A single motor 64 is rotationally coupled to each of the roller assemblies 12, 14 by a variety of belt drive assemblies to drive the rollers 24, 26, 24' 26' at a constant and equal rotational speed. The rollers are 24, 26, 24' 26' are biased to effect optimum frictional engagement with the face surfaces of the stacked sheet material and vary the nip spacing as a function of the thickness of the stacked collation SC. Finally, the transmission assembly is adapted to drive the rollers 24, 26, 24' 26' and permit the nip spacing to vary, thereby enabling the conveyance/processing of variable thickness collations.

It is to be understood that all of the present figures, and the accompanying narrative discussions of preferred embodiments, do not purport to be completely rigorous treatments of the methods and systems under consideration. For example, while the invention describes an interval of time for completing a phase of sorting operations, it should be appreciated that the processing time may differ. A person skilled in the art will understand that the steps of the present application represent general cause-and-effect relationships that do not exclude intermediate interactions of various types, and will further understand that the various structures and mechanisms described in this application can be implemented by a variety of different combinations of hardware and software, methods of escorting and storing individual mailpieces and in various configurations which need not be further elaborated herein.

The invention claimed is:

1. A roller assembly for conveying stacked sheet material along a feed path, comprising:

a first roller adapted for rotation about a first rotational axis within a structural housing, a second roller adapted for pivotal mounting about an axis within the structural housing and adapted for rotation about a second rotational axis parallel to the first rotational axis, the second roller opposing the first roller to define a roller nip operative to frictionally engage the stacked sheet material along exposed face surfaces thereof, and a transmission assembly supported within the structural housing and operative to: (i) transfer rotational motion of the first roller to the second roller, (ii) drive the first and second rollers in opposing directions to convey the stacked sheet material along the feed path, and (iii) facilitate pivot motion of the second roller about the pivot axis to vary the spacing of the roller nip for accommodating stacked sheet material of variable thickness, the transmission assembly further including:

a first input gear for driving the first roller in a first direction, a second input gear for driving the second roller in a second direction opposite the first direction, a torque transmitting gear receiving rotational input from the first input gear, and driving the second input gear, the torque transmitting gear having an axis of rotation coincident with the pivot axis of the second roller, and a belt drive assembly for transferring rotational input from the torque transmitting gear to the second input gear and facilitating pivot motion of the second roller about the pivot axis.

2. The roller assembly according to claim 1 further comprising a spring biasing mechanism operative to bias the second roller about the pivot axis toward the first roller to effect optimum frictional engagement of the roller nip with the face surfaces of the stacked sheet material.

3. The roller assembly according to claim 2 wherein the second roller is pivotally mounted about the pivot axis by a lever having a lever arm, and wherein the spring biasing mechanism includes a radial arm integrated with the lever arm and a coil spring interposing an end of the lever arm and a bearing surface.

4. The roller assembly according to claim 3 wherein the spring biasing mechanism includes a pair of levers disposed at each end of the second roller.

5. The roller assembly according to claim 2 wherein the spring biasing mechanism includes a yoke-shaped lever having a pair of radial arms mounting to a central portion of the second roller.

6. The roller assembly according to claim 1 wherein the torque transmitting gear is a spur gear mounted for rotation to the structural housing and wherein the belt drive assembly includes a pinion gear mounting to and rotating with the spur gear and a cogged belt rotationally coupling the pinion gear to the second input gear of the second roller.

7. A feed module for conveying stacked sheet material along a feed path, comprising:

a housing having a pair of sidewall structures and crossbeam members connecting the sidewall structures;

a roller assembly including:

a first roller rotationally mounting to the housing and adapted for rotation about a first rotational axis, a second roller pivotally mounting about an axis to the housing and adapted for rotation about a second rotational axis parallel to the first rotational axis, the second roller opposing the first roller to define a roller nip operative to frictionally engage the stacked sheet material along exposed face surfaces thereof, a transmission assembly supported within the housing and operative to: (i) transfer rotational motion of the first roller to the second roller, (ii) drive the first and second rollers in opposing directions to convey the stacked sheet material along the feed path, and (iii) facilitate pivot motion of the second roller about the pivot axis to vary the spacing of the roller nip for accommodating stacked sheet material of variable thickness, the transmission assembly including:

a first input gear for driving the first roller in a first direction, a second input gear for driving the second roller in a second direction opposite the first direction, a torque transmitting gear receiving rotational input from the first input gear, and driving the second input gear, the torque transmitting gear having an axis of rotation coincident with the pivot axis of the second roller, and a belt drive assembly for transferring rotational input from the torque transmitting gear to the second input gear and facilitating pivot motion of the second roller about the pivot axis, and a spring biasing mechanism operative to bias the second roller about the pivot axis toward the first roller to effect optimum frictional engagement of the roller nip with the face surfaces of the stacked sheet material.

8. The roller assembly according to claim 7 wherein the second roller is pivotally mounted about the pivot axis by a lever having a lever arm, and wherein the spring biasing mechanism includes a radial arm integrated with the lever arm and a coil spring interposing an end of the lever arm and a bearing surface of the housing.

9. The feed module according to claim 8 wherein the spring biasing mechanism includes a pair of levers disposed at each end of the second roller.

10. The feed module according to claim 7 wherein the housing includes a cantilever beam normal to, and projecting laterally from, one of the sidewall structures, and wherein the spring biasing mechanism includes:

a yoke-shaped lever pivotally mounting about the pivot axis of the second roller and having a pair of radial arms mounting to a central portion of the second roller and a crossbeam member connecting the radial arms, and at least one coil spring disposed between the crossbeam member and a bearing surface of the cantilever beam to bias the second roller toward the first roller about the pivot axis.

11. The roller assembly according to claim 7 wherein the torque transmitting gear is a spur gear mounted for rotation to the structural housing and wherein the belt drive assembly includes a pinion gear mounting to and rotating with the spur gear and a cogged belt rotationally coupling the pinion gear to the second input gear of the second roller.

* * * * *